US007850165B2

(12) United States Patent
Nagura et al.

(10) Patent No.: US 7,850,165 B2
(45) Date of Patent: Dec. 14, 2010

(54) PAPER SHEET STORING APPARATUS

(75) Inventors: Akihiro Nagura, Nagakute (JP); Yasuhiro Nakata, Owariasahi (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 12/141,945

(22) Filed: Jun. 19, 2008

(65) Prior Publication Data

US 2009/0014946 A1 Jan. 15, 2009

(30) Foreign Application Priority Data

Jul. 9, 2007 (JP) ..... 2007-179859

(51) Int. Cl.
*B65H 29/38* (2006.01)

(52) U.S. Cl. ..... 271/181; 271/177; 271/213

(58) Field of Classification Search ..... 271/3.12, 271/3.01, 213, 177, 181, 217
See application file for complete search history.

(56) References Cited

U.S. PATENT DOCUMENTS

| | | | | |
|---|---|---|---|---|
| 3,814,415 | A * | 6/1974 | Hunter et al. | 271/181 |
| 4,019,730 | A * | 4/1977 | Staudinger et al. | 271/181 |
| 4,441,702 | A * | 4/1984 | Nagel et al. | 271/177 |
| 5,064,185 | A * | 11/1991 | Ricciardi | 271/181 |
| 5,224,697 | A * | 7/1993 | Darchis et al. | 271/201 |
| 5,372,360 | A * | 12/1994 | Ricciardi | 271/177 |
| 5,467,974 | A * | 11/1995 | Ishiwata et al. | 271/220 |
| 5,836,577 | A * | 11/1998 | Arikawa et al. | 270/58.04 |
| 6,161,830 | A * | 12/2000 | Yap | 271/181 |
| 7,029,008 | B2 | 4/2006 | Nishida et al. | |
| 7,455,183 | B2 | 11/2008 | Nishida et al. | |
| 7,487,874 | B2 | 2/2009 | Nishida et al. | |

FOREIGN PATENT DOCUMENTS

| | | | |
|---|---|---|---|
| CN | 1508056 | A | 6/2004 |
| EP | 552779 | A1 * | 7/1993 |
| EP | 0532217 | B1 | 12/1996 |
| JP | 2006-021860 | | 1/2006 |

OTHER PUBLICATIONS

Chinese Office Action dated Nov. 13, 2009, issued in corresponding Chinese Patent Application No. 200810108310.

* cited by examiner

*Primary Examiner*—Kaitlin S Joerger
(74) *Attorney, Agent, or Firm*—Antonelli, Terry, Stout & Kraus, LLP.

(57) ABSTRACT

A paper sheet storing apparatus is configured to collect and accumulate multiple different types of paper sheets in different sizes. The paper sheet storing apparatus has: a paper sheet cartridge configured to have a feeder provided on a side wall thereof for externally feeding paper sheets and arranged to accumulate and keep the paper sheets therein; and a stack guide member configured to introduce the paper sheets, which are fed by the feeder into the paper sheet cartridge, downward in the paper sheet cartridge and to press down surface of an uppermost paper sheet located on a top of the paper sheets accumulated and kept in the paper sheet cartridge. The stack guide member is structured in a specific shape to enable the surface of the uppermost paper sheet to be pressed downward in a vertical direction, with regard to all the multiple different types of paper sheets. This arrangement effectively reduces the potential for paper jams and relevant troubles and ensures stable accumulation of paper sheets.

9 Claims, 5 Drawing Sheets

PAPER SHEET STORING APPARATUS

BACKGROUND OF THE INVENTION

1. Field of the Invention

The present invention relates to a paper sheet storing apparatus, and more specifically to a paper sheet storing apparatus configured to collect and accumulate multiple different types of paper sheets in different sizes.

2. Description of the Related Art

Automatic teller machines are generally used for the users' financial transactions including cash deposits and withdrawals in financial facilities and organizations. The automatic teller machine is equipped with a paper sheet handling system designed to handle diversity of paper sheets including banknotes or bills and forms and slips. The paper sheet handling system includes a paper sheet storing apparatus configured to collect and accumulate externally fed paper sheets. The paper sheet storing apparatus has a paper sheet cartridge to accumulate and keep the paper sheets therein.

In the paper sheet storing apparatus, paper sheets newly and subsequently conveyed into the paper sheet cartridge may collide with paper sheets conveyed and accumulated in advance in the paper sheet cartridge. Such collision may bend or fold the paper sheets and may even cause paper jams and other relevant troubles. Such troubles are especially noticeable in accumulation of paper sheets creased or folded in directions substantially perpendicular to their conveying direction into the paper sheet cartridge.

Various techniques applied to the paper sheet storing apparatus have been proposed to eliminate such troubles. For example, a technique on a paper sheet storing releasing apparatus disclosed in Japanese Patent Laid-Open No. 2006-21860 aims to enable stable accumulation and release of even the paper sheets creased or folded in the directions substantially perpendicular to the conveying direction.

The paper sheet handling system, for example, a cash handling system, mounted on the automatic teller machine is generally equipped with cash storing releasing apparatus (cash circulation cartridges) configured to classify and accumulate normal banknotes or bills suitable for circulation (hereafter may be referred to as circulation bills) by denominations and to release the accumulated normal bills, as well as with a cash storing apparatus (reject cartridge) configured to collect and accumulate bills unsuitable for circulation, for example, significantly damaged bills (hereafter may be referred to as rejected bills). In the cash circulation cartridges, the bills are aligned and accumulated to facilitate stable release and conveyance of the accumulated bills. For efficient storage of the rejected bills, the rejected bills may also be aligned and accumulated in the reject cartridge. For the purpose of downsizing the whole automatic teller machine, multiple different denominations of bills, that is, multiple different types of bills in different sizes, are generally accumulated simultaneously in one reject cartridge.

SUMMARY OF THE INVENTION

The technique of the above cited reference, however, does not consider the case of such simultaneous accumulation of multiple different types of paper sheets (for example, banknotes or bills) in different sizes in one paper sheet cartridge. For the simultaneous accumulation of multiple different types of paper sheets in different sizes in one paper sheet cartridge, the paper sheet cartridge should be designed in certain dimensions to allow accumulation of maximum size paper sheets. In the case of accumulation of smaller size paper sheets in the paper sheet cartridge of this design, however, there may be a relatively large clearance formed between a side wall of the paper sheet cartridge and the paper sheets accumulated therein. A front end of the paper sheet along its conveying direction may be stuck in this clearance and cause a rear end of the paper sheet along its conveying direction to be lifted up. This may lead to a paper jam or another relevant trouble.

In a paper sheet storing apparatus constructed to collect and accumulate multiple different types of paper sheets, there would thus be a demand for reducing the potential for paper jams and relevant troubles and ensures stable accumulation of paper sheets.

The present invention accomplishes at least part of the demands mentioned above by the following configurations applied to the paper sheet storing apparatus, the paper sheet handling system, and the automatic teller machine.

According to one aspect, the present invention is directed to a paper sheet storing apparatus configured to collect and accumulate multiple different types of paper sheets in different sizes. The paper sheet storing apparatus has: a paper sheet cartridge configured to have a feeder provided on a side wall thereof for externally feeding paper sheets and arranged to accumulate and keep the paper sheets therein; and a stack guide member configured to introduce the paper sheets, which are fed by the feeder into the paper sheet cartridge, downward in the paper sheet cartridge and to press down surface of an uppermost paper sheet located on a top of the paper sheets accumulated and kept in the paper sheet cartridge. The stack guide member is structured in a specific shape to enable the surface of the uppermost paper sheet to be pressed downward in a vertical direction, with regard to all the multiple different types of paper sheets.

In the paper sheet storing apparatus according to the above aspect of the invention, multiple different types of paper sheets in different sizes are accumulated and kept in the paper sheet cartridge. The stack guide member is structured in the specific shape to enable the surface of the uppermost paper sheet located on the top of the paper sheets in the paper sheet cartridge to be pressed downward in the vertical direction, with regard to all the multiple different types of paper sheets in different sizes accumulated and kept in the paper sheet cartridge. The function of the stack guide member effectively prevents a front end of the paper sheet along the conveying direction from being stuck in a clearance between the side wall of the paper sheet cartridge and the accumulated paper sheets and prevents an edge of the uppermost paper sheet located on the top of the paper sheets in the paper sheet cartridge from being pressed against the clearance. Namely the stack guide member works to prevent a rear end of the uppermost paper sheet along the conveying direction in the paper sheet cartridge from being undesirably lifted up. This arrangement effectively reduces the potential for paper jams and relevant troubles and ensures stable accumulation of paper sheets. Typical examples of the paper sheets are banknotes or bills and forms and slips.

In one preferable application of the paper sheet storing apparatus according to the above aspect of the invention, the paper sheets are substantially rectangular in shape and are conveyed into the feeder in a substantially widthwise direction of the paper sheets or in a substantially longitudinal direction of the paper sheets as a conveying direction. The stack guide member has a projection formed to press down the surface of the uppermost paper sheet, which is located on the top of the paper sheets accumulated and kept in the paper sheet cartridge, at a specific point close to a centerline substantially parallel to the conveying direction.

In the paper sheet storing apparatus of this application, the projection formed on the stack guide member presses down the paper sheets accumulated and kept in the paper sheet cartridge at the specific point close to their centerlines practically parallel to the conveying direction. When the paper sheet conveyed into the feeder is misaligned in a direction perpendicular to the conveying direction or is inclined to the conveying direction, the pressing force by the projection, in combination with the conveying force, rotates the paper sheet about the specific point pressed by the projection. A partial circumference of the rotating paper sheet accordingly collides with and is brought into contact with the side wall of the paper sheet cartridge. This arrangement effectively prevents formation of the clearance between the side wall of the paper sheet cartridge and the accumulated paper sheets to make subsequently fed and accumulated paper sheets stuck therein.

In the paper sheet storing apparatus of this application, the conveying direction may be, for example, the substantially widthwise direction of the paper sheets.

In the paper sheet storing apparatus of this example, the conveying direction of the paper sheets is the substantially widthwise direction of the paper sheets, so that the direction substantially perpendicular to the conveying direction is the substantially longitudinal direction of the paper sheets. The paper sheet has a greater moment of rotation in the substantially widthwise direction of the paper sheet set as the conveying direction than the moment of rotation in the substantially longitudinal direction of the paper sheet set as the conveying direction. When the paper sheet conveyed into the feeder is misaligned in the direction perpendicular to the conveying direction or is inclined to the conveying direction, the paper sheet is thus more likely to rotate about the specific point pressed by the projection. A partial circumference of the rotating paper sheet accordingly collides with and is brought into contact with the side wall of the paper sheet cartridge. This arrangement effectively prevents formation of the clearance between the side wall of the paper sheet cartridge and the accumulated paper sheets to make subsequently fed and accumulated paper sheets stuck therein. The paper sheet is often creased in a direction parallel to the widthwise direction. Setting the conveying direction of the paper sheets to the substantially widthwise direction of the paper sheets desirably prevents a fold of the paper sheet and enables the paper sheets to be stably fed into the paper sheet cartridge.

In one preferable embodiment of the paper sheet storing apparatus of the above application, a distance from the side wall of the paper sheet cartridge equipped with the feeder to the projection formed on the stack guide member is less than a length of a minimum size paper sheet in a widthwise direction thereof among the multiple different types of paper sheets.

This arrangement effectively presses down the minimum size paper sheets among the multiple different types of paper sheets accumulated and kept in the paper sheet cartridge.

In another preferable application of the paper sheet storing apparatus according to the above aspect of the invention, the paper sheet cartridge has a bottom plate formed in preset dimensions that are greater than dimensions of a maximum size paper sheet among the multiple different types of paper sheets.

Even when the paper sheets conveyed into the feeder are inclined to some extent, this arrangement ensures stable accumulation of the paper sheets in the paper sheet cartridge.

In one preferable embodiment according to the invention, a vertically movable bottom plate member forms a bottom plate of the paper sheet cartridge. The paper sheet storing apparatus further has a lift mechanism to move up and down the bottom plate member.

In the paper sheet storing apparatus of this embodiment, the bottom plate member of the paper sheet cartridge is moved up and down by the lift mechanism. This arrangement allows an accumulation capacity of the paper sheets to be arbitrarily set in the paper sheet cartridge.

In one preferable application of this embodiment, the stack guide member has a substantially plate-like shape and is arranged to be swung in the vertical direction about a preset pivot shaft provided above the feeder. The paper sheet storing apparatus further has: a detector configured to detect an angle of a guide plane of the stack guide member and a horizontal plane, where the guide plane of the stack guide member is formed to introduce the fed paper sheets downward in the paper sheet cartridge; and a lift controller configured to refer to the angle detected by the detector and control the lift mechanism to keep the angle constant.

In the paper sheet storing apparatus of this application, when the paper sheets are fed by the feeder into the paper sheet cartridge, the front edges of the fed paper sheets are brought into contact with the guide plane of the stack guide member at a substantially constant angle. This arrangement ensures stable introduction and accumulation of the paper sheets in the paper sheet cartridge.

In another preferable embodiment according to the invention, the paper sheet storing apparatus further has a hitting member structured to hit rear ends of the paper sheets fed by the feeder into the paper sheet cartridge and thereby drop the paper sheets down into the paper sheet cartridge below the feeder.

In the paper sheet storing apparatus of this embodiment, the rear ends of the paper sheets fed by the feeder into the paper sheet cartridge are hit by the hitting member to drop the paper sheets down into the paper sheet cartridge below the feeder. This arrangement effectively prevents paper sheets newly and subsequently conveyed into the paper sheet cartridge from colliding with paper sheets conveyed and accumulated in advance in the paper sheet cartridge.

According to another aspect, the present invention is directed to a paper sheet handling system equipped with the paper sheet storing apparatus having any of the arrangements described above.

According to still another aspect, the present invention is directed to an automatic teller machine equipped with the paper sheet handling system.

The technique of the invention is not restricted to the paper sheet storing apparatus, the paper sheet handling system, or the automatic teller machine described above, but is also actualized by diversity of other applications, for example, a copying machine equipped with the paper sheet storing apparatus and a printing device equipped with the paper sheet storing apparatus. Any of the various additional arrangements explained above may be adopted in any of these applications.

DESCRIPTION OF THE PREFERRED EMBODIMENTS

One mode of carrying out the invention is described below as a preferred embodiment with reference to the accompanied drawings:

A. Configuration of Automatic Teller Machine
B. Structure of Cash Handling System
C. Reject Cartridge
C1. Structure of Reject Cartridge
C2. Operations of Reject Cartridge
C3. Functions of Stack Guide
D. Other Aspects

A. Configuration of Automatic Teller Machine

Figure 1:
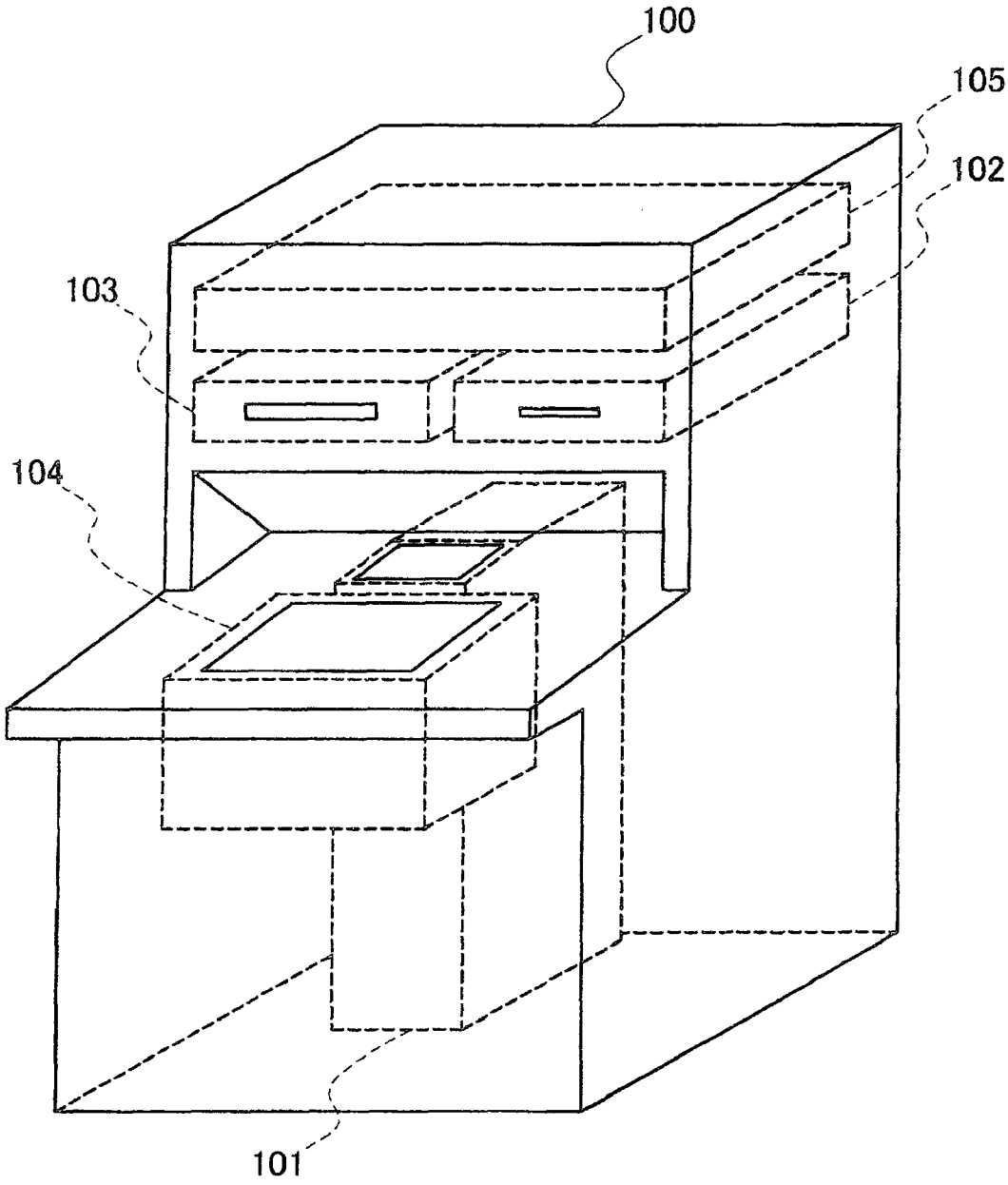
FIG. 1 shows the appearance of an automatic teller machine in one embodiment of the invention.

FIG. 1 shows the appearance of an automatic teller machine 100 in one embodiment of the invention. The automatic teller machine 100 is installed, for example, in a bank or in a convenience store and is used for various financial transactions including deposit and withdrawal transactions in response to the users' operations. As illustrated, the automatic teller machine 100 includes a cash handling system 101, a card/statement processor 102, a passbook processor 103, a user operation unit 104, and a main controller 105.

The cash handling system 101 is configured to keep banknotes or bills deposited by the users and to withdraw the bills kept therein in response to the users' requests. The cash handling system 101 has a cash slot for deposit and withdrawal of bills. In deposit transactions, the bills inserted by the user are checked for the authenticity and significant damage, are classified by the denominations, and are collected and accumulated in cash circulation cartridges and a reject cartridge (described later). In withdrawal transactions, required numbers of respective denomination bills corresponding to the user's specified amount of money are taken out of the cash circulation cartridges to the user via the cash slot. The cash handling system 101 is one embodiment of the paper sheet handling system of the invention and will be described in detail later.

The card/statement processor 102 is configured to read information recorded on a magnetic stripe card (cash card) and issue a transaction statement as a record of the details of each financial transaction. The information recorded on the magnetic stripe card includes, for example, a number allocated to each financial facility, a transaction item, and each user's bank account number.

The passbook processor 103 is configured to read printed marks and other data from each user's passbook and to print required data on the passbook in response to each financial transaction.

The user operation unit 104 is a user interface configured to give the user a guidance display for deposit, withdrawal, and other financial transactions and to receive the user's entries for the deposit, withdrawal, and other financial transactions. A touch panel is used for the user operation unit 104 in this embodiment, but may be replaced with another equivalent device, for example, the combination of a display and some press button switches.

The main controller 105 is constructed as a microcomputer including a CPU and memories. The main controller 105 transmits information to and from the cash handling system 101, the card/statement processor 102, the passbook processor 103, and the user operation unit 104 and controls the operations of the whole automatic teller machine 100.

B. Structure of Cash Handling System

Figure 2:
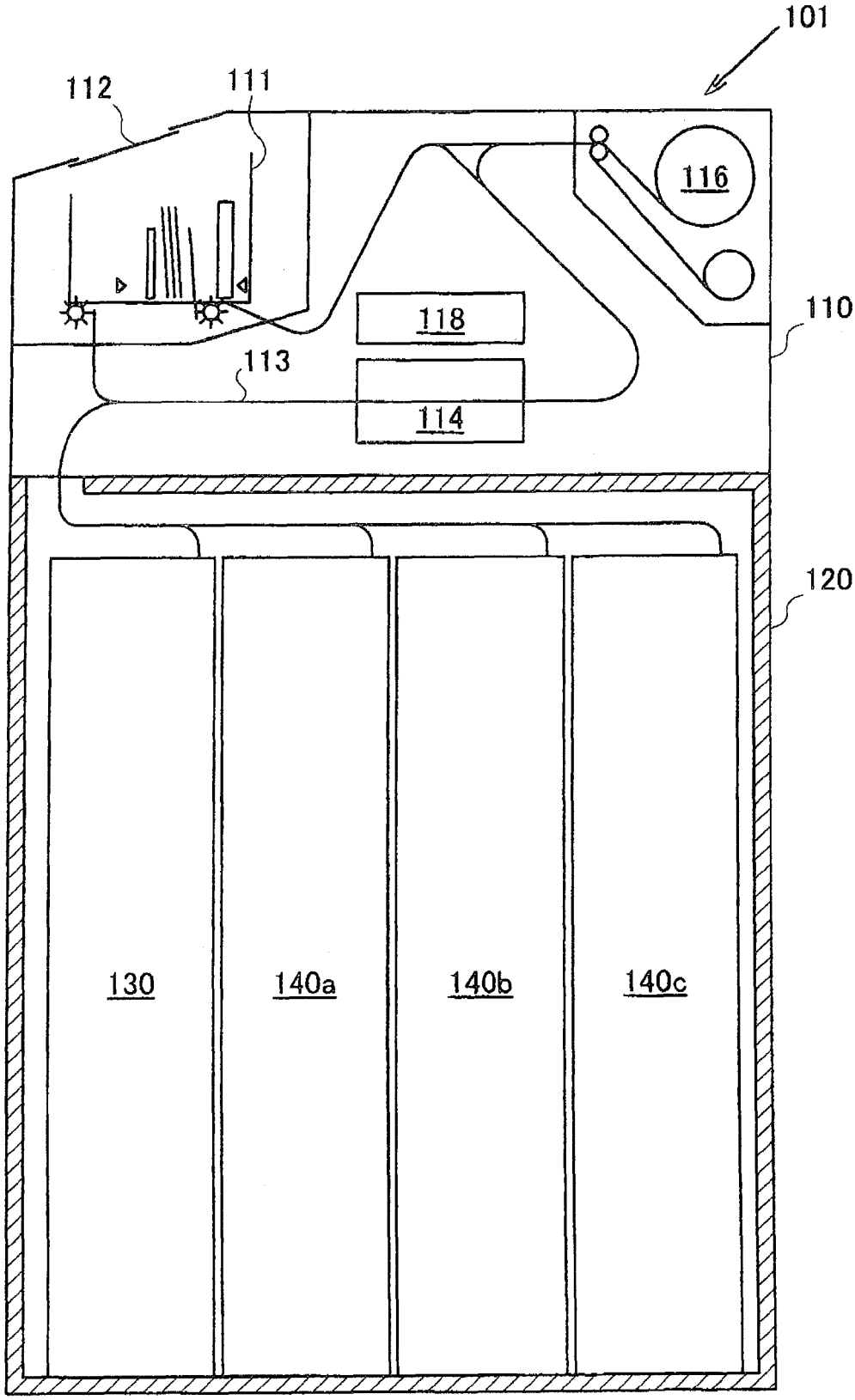
FIG. 2 shows the schematic structure of a cash handling system included in the automatic teller machine in the embodiment of the invention.

FIG. 2 is a side sectional view showing the schematic structure of the cash handling system 101 in the embodiment of the invention. The cash handling system 101 of this embodiment is designed as a circulation type structure to circulate and reuse deposited and accumulated bills for subsequent withdrawal transactions. This structure is, however, not restrictive, but the cash handling system 101 may be designed as a non-circulation type structure not to circulate or reuse the deposited and accumulated bills for the subsequent withdrawal transactions. As illustrated, the cash handling system 101 includes an upper unit 110 and a vault 120.

The upper unit 110 includes a cash delivery assembly 111 with a shutter 112, a bill conveying line 113, a bill detector 114, a temporary cabinet 116, and a control unit 118.

The cash delivery assembly 111 includes a cash slot designed to be accessible for the user's insertion and withdrawal of bills and various rollers. The shutter 112 is opened and closed, in response to the user's operation of the user operation unit 104 provided on the automatic teller machine 100. The cash delivery assembly 111 is also equipped with a sensor for sensing insertion of bills or detecting the presence of bills.

The bill conveying line 113 is arranged to convey the bills in the cash handling system 101. The bill conveying line 113 has conveyor belts and multiple rollers provided to hold the bills and drive motors used to drive the multiple rollers, although not being specifically illustrated. The bill conveying line 113 is also equipped with multiple sensors provided at adequate positions for detecting the passage of bills. The bill conveying line 113 has gates provided at its respective branches and driven by, for example, electromagnetic solenoids to switch over the conveyance destination of each bill. In this embodiment, the conveying direction of the bills is a widthwise direction of the bills.

The bill detector 114 is located on the bill conveying line 113. The bill detector 114 has various sensors provided to check each of the bills conveyed on the bill conveying line 113 from the cash delivery assembly 111 for its denomination and its suitability or unsuitability for circulation (authenticity and damage condition of the bill) and output the check results. The bills are checked by utilizing various pieces of information, for example, image data obtained by scanning the respective bills and their magnetic properties and optical properties measured with, for example, ultraviolet rays. The sensors usable for checking the bills include, for example, contact sensors, reflective sensors, transmission sensors, color sensors, and infrared sensors. Multiple sensors may be selectively combined for checking the bills.

The temporary cabinet 116 is used to temporarily store the conveyed bills in the course of each deposit or withdrawal transaction. The temporary cabinet 116 is designed to accumulate the bills in a conveying order and to deliver the bills in its reverse order. The temporary cabinet 116 of this embodiment adopts a mechanism of holding the bills by means of a belt wound on the circumference of a rotary drum.

The control unit 118 is constructed as a microcomputer including a CPU and memories and controls the operations of the respective constituents in the cash handling system 101 including the cash circulation cartridges and the reject cartridge (described later) according to preset programs. The control unit 118 transmits information to and from the main controller 105 provided in the automatic teller machine 100.

The vault 120 is covered with a thick metal plate and is designed to be tough and rigid for safety. The vault 120 has three cash circulation cartridges 140*a*, 140*b*, and 140*c* configured to collect and accumulate normal bills suitable for circulation, that is, bills usable for subsequent withdrawal transactions, and one reject cartridge 130 configured to collect and accumulate bills unsuitable for circulation and subsequent financial transactions, for example, significantly damaged bills and counterfeit bills (hereafter referred to as rejected bills).

In the structure of this embodiment, the cash circulation cartridge 140*a*, the cash circulation cartridge 140*b*, and the cash circulation cartridge 140*c* are respectively allocated to accumulate and store 10000 yen bills, 5000 yen bills, and 1000 yen bills. The cash handling system 101 may further has an additional cash circulation cartridge for accumulation and storage of 2000 yen bills. The respective cash circulation cartridges provided in the cash handling system 101 may be allocated to accumulate and store bills of another currency, for example, US dollar bills or UK pond bills, instead of the Japanese currency.

The reject cartridge 130 is designed to simultaneously collect and accumulate multiple different types of rejected bills in different sizes, that is, rejected bills of different denominations. The reject cartridge 130 is one embodiment of the paper sheet storing apparatus of the invention. In the structure of this embodiment, the cash handling system 101 includes only one reject cartridge 130. This is, however, not restrictive, but the cash handling system 101 may include multiple reject cartridges 130 for accumulation and storage of a greater mass of rejected bills. The details of the reject cartridge 130 are discussed below.

C. Reject Cartridge

C1. Structure of Reject Cartridge

Figure 3:
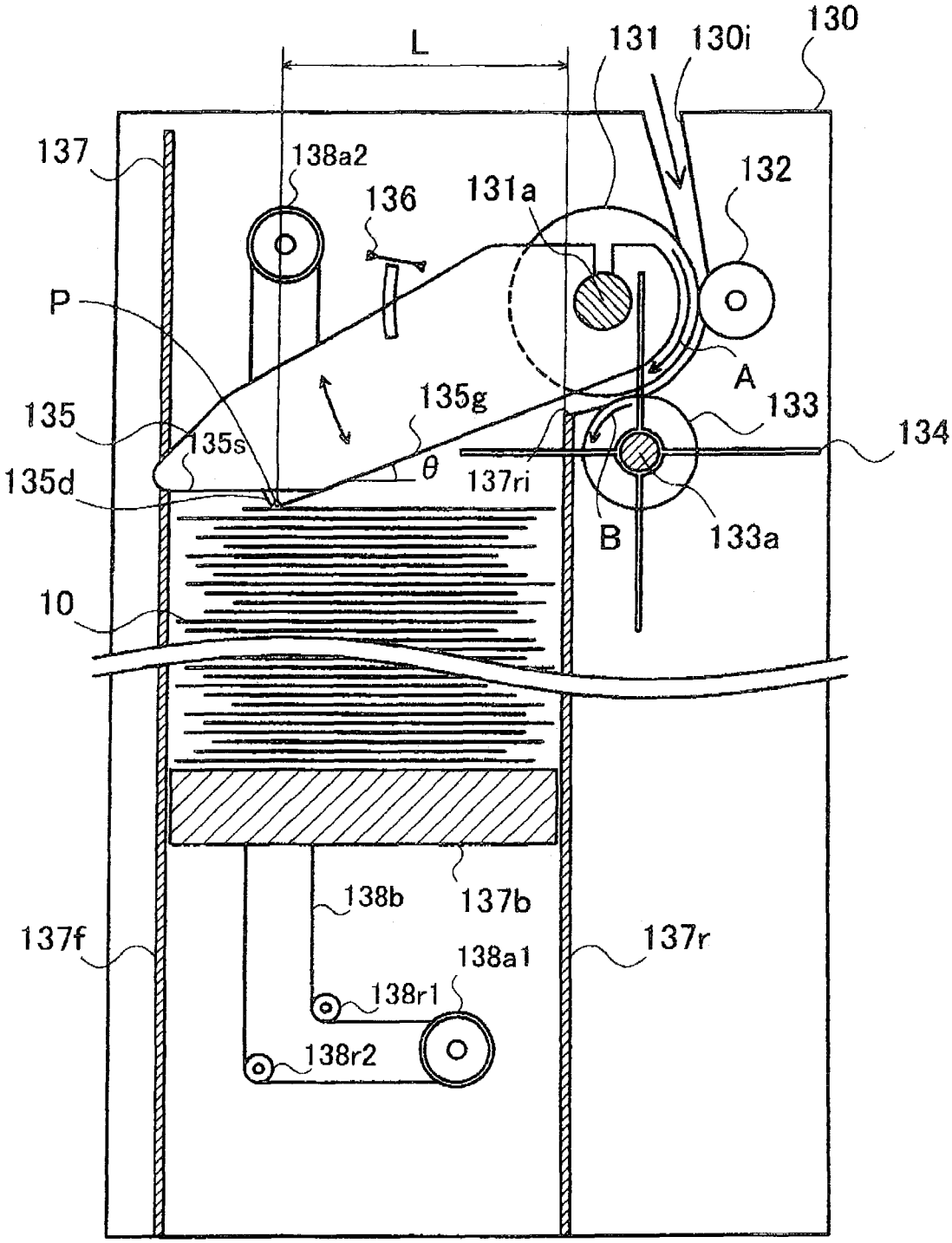
FIG. 3 shows the schematic structure of a reject cartridge included in the cash handling system.

FIG. 3 is a side sectional view showing the schematic structure of the reject cartridge 130. As illustrated, the reject cartridge 130 includes an inlet 130*i*, a feed roller 131, pinch rollers 132 and 133, a sheet roller 134, a stack guide 135, a sensor 136, and a storage cartridge 137.

Figure 4C:
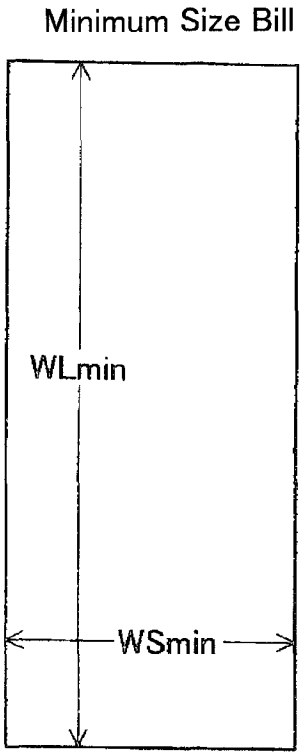
FIG. 4 shows the function of a stack guide in the reject cartridge.
Figure 4B:
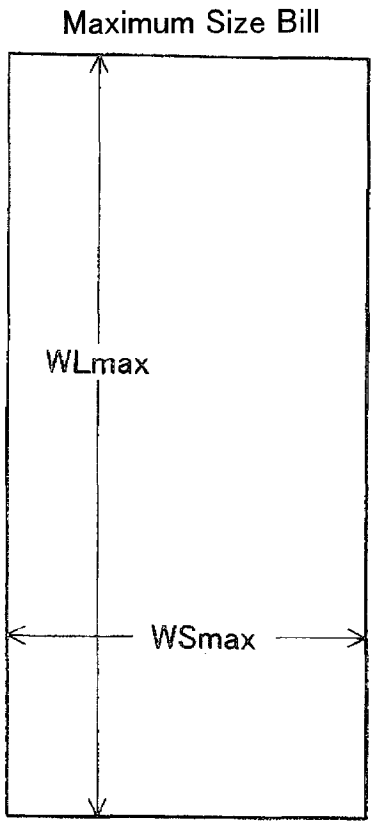
Figure 4A:
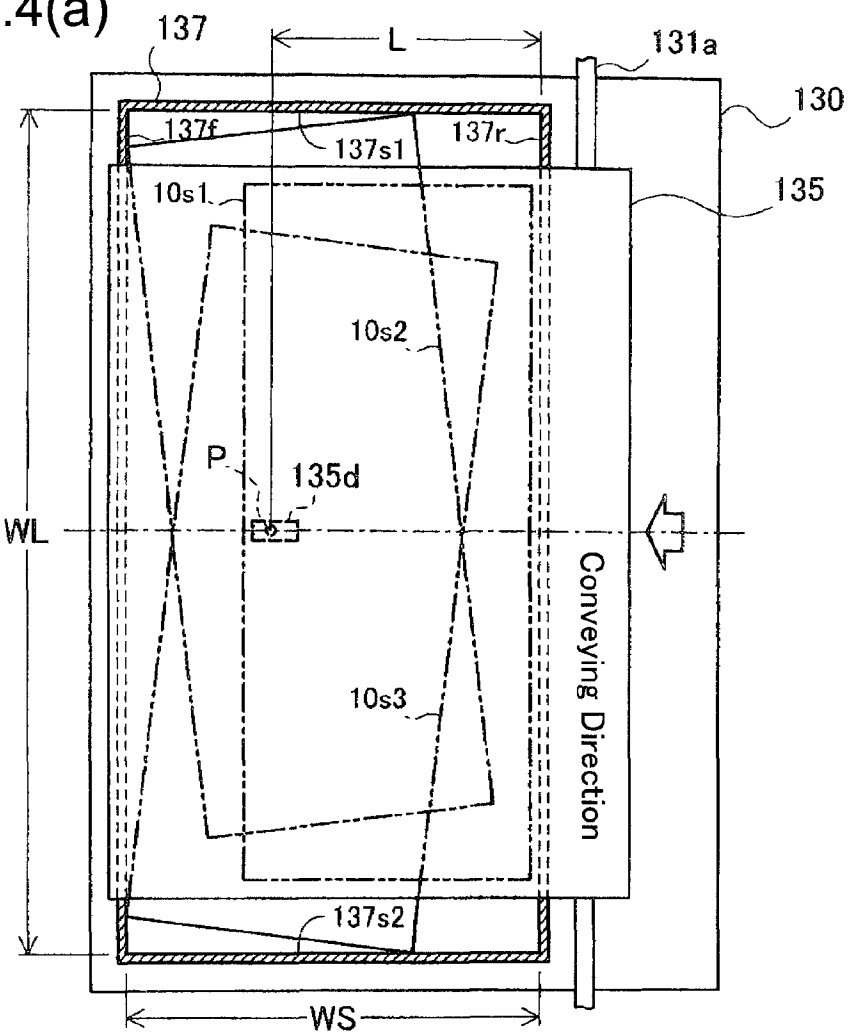

The storage cartridge 137 is used to accumulate and store rejected bills 10 and is designed to have a rectangular cross section seen from the top (FIG. 4(*a*)). The dimensions of the rectangular storage cartridge 137 are set to be greater than the dimensions of maximum size rejected bills 10 accumulated in the storage cartridge 137. The storage cartridge 137 has a $1^{st}$ side wall 137*r* with a feeder 137*ri*, a $2^{nd}$ side wall 137*f* facing the $1^{st}$ side wall 137*r*, a $3^{rd}$ side wall 137*s*1 (explained later), a fourth side wall 137*s*2 facing the $3^{rd}$ side wall 137*s*1, and a vertically movable plate 137*b* as a bottom plate for accumulation of the rejected bills 10 thereon. The vertically movable plate 137*b* is lifted up and down in a vertical direction by means of a lift mechanism (explained later).

A rotating shaft 131*a* of the feed roller 131 and a rotating shaft 133*a* of the pinch roller 133 and the sheet roller 134 have gears (not shown) on their respective one ends. The feed roller 131, the pinch roller 133, and the sheet roller 134 are driven and rotated by motors (not shown). In conveyance and accumulation of each rejected bill 10, the feed roller 131 rotates in a direction of an arrow A, while the pinch roller 133 rotates in a direction of an arrow B. The pinch roller 132 is in contact with the feed roller 131 and rotates with the rotation of the feed roller 131. The sheet roller 134 rotates in conjunction with the pinch roller 133. The sheet roller 134 is designed as a roller with elastic brushes to hit a rear end of each rejected bill 10 and thereby drop the rejected bill 10 down in the storage cartridge 137 for accumulation in the storage cartridge 137. The sheet roller 134 is one embodiment of the hitting member of the invention.

The stack guide 135 is a plate-like member and is provided to be swung in the vertical direction about a pivot shaft located above the feeder 137*ri*. As illustrated, in the structure of this embodiment, the rotating shaft 131*a* of the feed roller 131 works as the pivot shaft of the stack guide 135. The stack guide 135 has a projection 135*d* formed on its lower face 135*s*. In the absence of any rejected bills 10 in the storage cartridge 137, the vertically movable plate 137*b* is lifted up to an uppermost position by the lift mechanism, and the projection 135*d* formed on the lower face 135*s* of the stack guide 135 is brought into contact with an upper face of the vertically movable plate 137*b* by the self weight of the stack guide 135. In the presence of the rejected bills 10 accumulated in the storage cartridge 137, on the other hand, the projection 135*d* formed on the lower face 135*s* of the stack guide 135 is brought into contact with the top surface of the rejected bills 10 accumulated on the vertically movable plate 137*b* and press down the rejected bills 10 in the vertical direction by the self weight of the stack guide 135.

In the structure of this embodiment, the stack guide 135 has only one projection 135*d*. The stack guide 135 has a guide plane 135*g* designed to have an acute angle to a horizontal plane (the upper face of the vertically movable plate 137*b* or the top surface of the rejected bills 10 accumulated on the vertically movable plate 137*b*). The lower face 135*s* of the stack guide 135 is formed to be substantially parallel to the horizontal plane when the projection 135*d* of the stack guide 135 is in contact with the upper face of the vertically movable plate 137*b* or with the top surface of the rejected bills 10 accumulated on the vertically movable plate 137*b*. The lower face 135*s* of the stack guide 135 is thus designed not to directly press down the upper face of the vertically movable plate 137*b* or the top surface of the rejected bills 10 accumulated on the vertically movable plate 137*b*.

The projection 135*d* is formed on the stack guide 135 at a specific position where a distance L between the projection 135*d* and the $1^{st}$ side wall 137*r* is less than a dimension of a minimum size rejected bill 10 in its widthwise direction. This arrangement enables the even minimum size rejected bills 10 among the multiple different types of rejected bills 10 in different sizes accumulated in the storage cartridge 137 to be effectively pressed down.

The sensor 136 is designed to detect an angle θ between the guide plane 135*g* of the stack guide 135 and the horizontal plane. The sensor 136 used in this embodiment is a light sensor including a light emitting element and a light receiving element, although another sensor may be used for the same purpose.

As the lift mechanism for lifting up and down the vertically movable plate 137*b* of the storage cartridge 137, the reject cartridge 130 has a drive belt 138*b*, drive rollers 138*a*1 and 138*a*2, rollers 138*r*1 and 138*r*2, and drive motors (not shown) for actuating the drive rollers 138*a*1 and 138*a*2.

C2. Operations of Reject Cartridge

The operations of the respective rollers in the reject cartridge 130 are controlled by the control unit 118 of the cash handling system 101 as explained previously.

Each rejected bill 10 fed via the inlet 130*i* is held by the feed roller 131 and the pinch rollers 132 and 133 and is conveyed from the feeder 137*ri* into the storage cartridge 137 by the rotating force of the feed roller 131 and the pinch rollers 132 and 133. When at least a front end of the rejected bill 10 comes into contact with the guide plane 135*g* of the stack guide 135, the rejected bill 10 is led down along the guide plane 135*g* and is thrown out. By means of the conveying force, the rejected bill 10 is then slid between the projection 135*d* of the stack guide 135 and the top surface of the rejected bills 10 accumulated in the storage cartridge 137 (or the upper face of the vertically movable plate 137*b* in the absence of any rejected bill 10 in the storage cartridge 137). The projection 135*d* of the stack guide 135 presses the slid rejected bill 10 down in the vertical direction at a contact point P to accumulate the rejected bill 10 in the storage cartridge 137.

The sheet roller 134 hits the rear end of the rejected bill 10 to drop down the rejected bill 10 in the storage cartridge 137 as explained previously. This arrangement effectively prevents rejected bills 10 newly and subsequently conveyed into the storage cartridge 137 from colliding with rejected bills 10 conveyed and accumulated in advance in the storage cartridge 137.

The vertically movable plate 137*b* is moved by the lift mechanism (described previously) to a specific position (height) where the guide plane 135*g* of the stack guide 135 has a substantially constant angle θ to the horizontal plane. The front end of the rejected bill 10 fed by the feeder 137*ri* is thus in contact with the guide plane 135*g* of the stack guide 135 at the substantially constant angle θ. This arrangement enables the conveyed rejected bills 10 to be stably led into the accumulation space in the storage cartridge 137.

C3. Functions of Stack Guide

FIG. 4 shows the functions of the stack guide 135 in the reject cartridge 130. FIG. 4(*a*) is a plan view of the reject cartridge 130. For the simplicity of illustration, the rollers explained above are omitted from FIG. 4(*a*). The stack guide 135 has a rectangular cross section seen from the top in FIG. 4(*a*), although the stack guide 135 may have a cross section of any other suitable shape. FIG. 4(*b*) and FIG. 4(*c*) are plan views respectively showing the maximum size rejected bill 10 (for example, 10000 yen bill) and the minimum size rejected bill 10 (for example, 1000 yen bill).

As shown in FIG. 4(*b*), the maximum size rejected bill 10 has a length WLmax in its longitudinal direction and a width WSmax in its widthwise direction. As shown in FIG. 4(*c*), the minimum size rejected bill 10 has a length WLmin in its longitudinal direction and a width WSmin in its widthwise direction. As shown in FIG. 4(*a*), a length WL of the storage cartridge 137 in its longitudinal direction is greater than the length WLmax of the maximum size rejected bill 10 in the longitudinal direction, and a width WS of the storage cartridge 137 in its widthwise direction is greater than the width WSmax of the maximum size rejected bill 10 in the widthwise direction. Even when the conveyed maximum size rejected bill 10 is inclined to the conveying direction, such dimensions of the storage cartridge 137 enable effective accumulation of the maximum size rejected bill 10 in the storage cartridge 137.

The projection 135*d* of the stack guide 135 is formed at a position close to a centerline substantially parallel to the conveying direction of the rejected bill 10, that is, at a position close to the center of the rejected bill 10 in its longitudinal direction, and on the center of the stack guide 135 in its longitudinal direction to effectively press down the top surface of the rejected bills 10 in the vertical direction, as shown in FIG. 4(*a*).

When the rejected bill 10 is not significantly inclined to the conveying direction and is conveyed from the substantial center of the stack guide 135, the rejected bill 10 is pressed down by the projection 135*d* of the stack guide 135 at a position close to the center of the rejected bill 10 in the longitudinal direction. The rejected bill 10 is thus accumulated in a non-inclined orientation to the conveying direction in the storage cartridge 137 as shown in a state 10*s*1 of FIG. 4(*a*).

When the conveyed rejected bill 10 is inclined rightward (upward in the drawing) to the conveying direction, the rejected bill 10 is pressed down by the projection 135*d* of the stack guide 135 at a position shifted leftward in the conveying direction from the center of the rejected bill 10 in the longitudinal direction. As explained previously, the lower face 135*s* of the stack guide 135 does not directly press down the surface of the rejected bill 10. There is accordingly little frictional resistance between the conveyed rejected bill 10 and the lower face 135*s* of the stack guide 135. The rejected bill 10 thus rotates counterclockwise about the contact point P by the moment of rotation and is accumulated in an inclined orientation to the conveying direction in the storage cartridge 137 as shown in a state 10*s*2 of FIG. 4(*a*). In this state 10*s*2, a partial circumference of the rejected bill 10 accumulated in the storage cartridge 137 is in connect with the $2^{nd}$ side wall 137*f* and the $3^{rd}$ side wall 137*s*1.

When the conveyed rejected bill 10 is inclined leftward (downward in the drawing) to the conveying direction, the rejected bill 10 is pressed down by the projection 135*d* of the stack guide 135 at a position shifted rightward in the conveying direction from the center of the rejected bill 10 in the longitudinal direction. As explained previously, the lower face 135*s* of the stack guide 135 does not directly press down the surface of the rejected bill 10. There is accordingly little frictional resistance between the conveyed rejected bill 10 and the lower face 135*s* of the stack guide 135. The rejected bill 10 thus rotates clockwise about the contact point P by the moment of rotation and is accumulated in an inclined orientation to the conveying direction in the storage cartridge 137 as shown in a state 10*s*3 of FIG. 4(*a*). In this state 10*s*3, a partial circumference of the rejected bill 10 accumulated in the storage cartridge 137 is in connect with the $2^{nd}$ side wall 137*f* and the $4^{th}$ side wall 137*s*2.

The rejected bills 10 conveyed in the inclined orientation are rotated in the above manner in the storage cartridge 137. This arrangement effectively prevents formation of the clearance between the side wall of the storage cartridge 137 and the accumulated rejected bills 10 to make subsequently fed and accumulated rejected bills 10 stuck therein.

In the structure of the reject cartridge 130 of the embodiment, the stack guide 135 is structured in the specific shape to enable the surface of the uppermost rejected bill 10 located on the top of the rejected bills 10 in the storage cartridge 137 to be pressed downward in the vertical direction, with regard to all the multiple different types of rejected bills 10 in different sizes accumulated and kept in the storage cartridge 137. The function of the stack guide 135 effectively prevents the front end of the rejected bill 10 along the conveying direction from being stuck in the clearance between the side wall of the storage cartridge 137 and the accumulated rejected bills 10 and prevents an edge of the uppermost rejected bill 10 located on the top of the rejected bills 10 in the storage cartridge 137 from being pressed against the clearance. Namely the stack guide 135 works to prevent the rear end of the uppermost rejected bill 10 along the conveying direction in the storage cartridge 137 from being undesirably lifted up. This arrangement effectively reduces the potential for paper jams and relevant troubles and ensures stable accumulation of the rejected bills 10.

D. Other Aspects

The embodiment discussed above is to be considered in all aspects as illustrative and not restrictive. There may be many modifications, changes, and alterations without departing from the scope or spirit of the main characteristics of the present invention. Some examples of possible modification are given below.

D1. Modified Example 1

Figure 5:
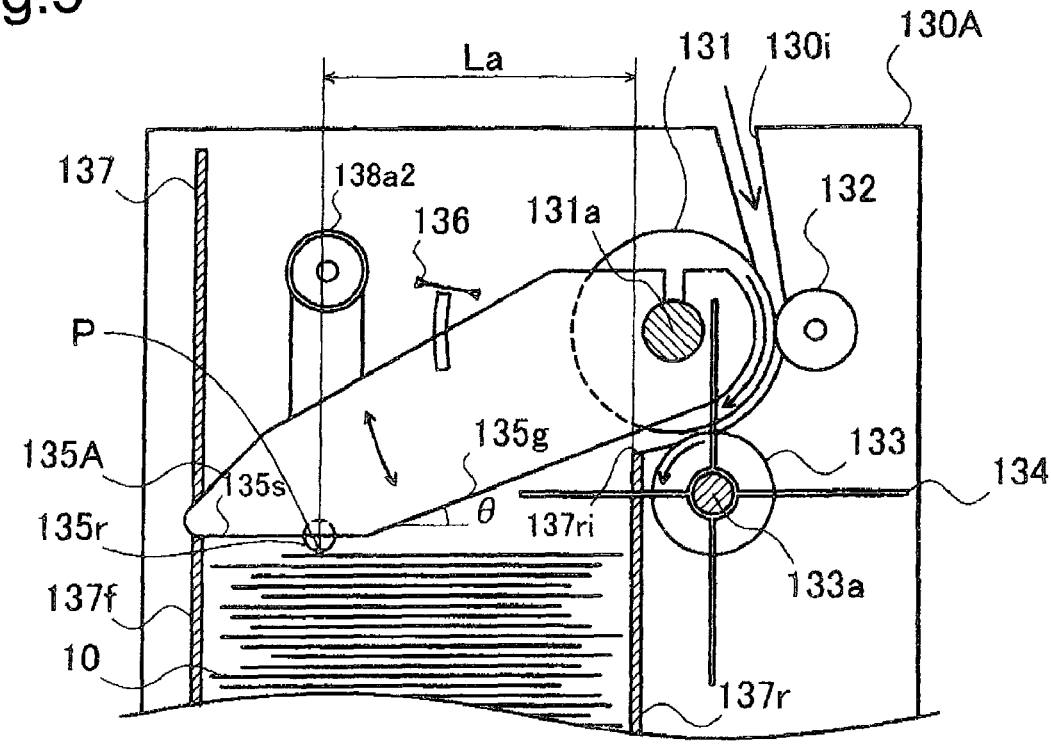
FIG. 5 shows the schematic structure of another reject cartridge in one modified example.

FIG. 5 is a side sectional view showing the schematic structure of another reject cartridge 130A in one modified example. The reject cartridge 130A of the modified example has a similar structure to that of the reject cartridge 130 of the embodiment, except a stack guide 135A provided in place of the stack guide 135.

In the reject cartridge 130A of the modified example, the stack guide 135A has a pressure roller 135*r* rotatable in the conveying direction of the rejected bills 10, in place of the projection 135*d* formed on the stack guide 135 in the reject cartridge 130 of the embodiment. The pressure roller 135*r* is extended downward from a lower face 135*s* of the reject cartridge 130A and presses down the rejected bills 10 collected and accumulated in a storage cartridge 137. A distance La between the pressure roller 135*r* and a $1^{st}$ side wall 137*r* is set to be less than the width WSmin of the minimum size rejected bill 10 in the widthwise direction shown in FIG. 4(*c*).

Like the reject cartridge 130 of the embodiment, the reject cartridge 130A of the modified example effectively reduces the potential for folding or creasing of the rejected bills 10 and their paper jams and relevant troubles in simultaneous accumulation of multiple different types of rejected bills 10 in different sizes in one storage cartridge 137 and thereby ensures stable accumulation of the rejected bills 10.

In the reject cartridge 130 of the embodiment, the stack guide 135 has one projection 135*d*. Similarly, in the reject cartridge 130A of the modified example, the stack guide 135A has one pressure roller 135*r*. This number is, however, neither restrictive nor essential, but multiple projections 135*d* or multiple pressure rollers 135*r* may be provided on the stack guide.

D2. Modified Example 2

Figure 6:
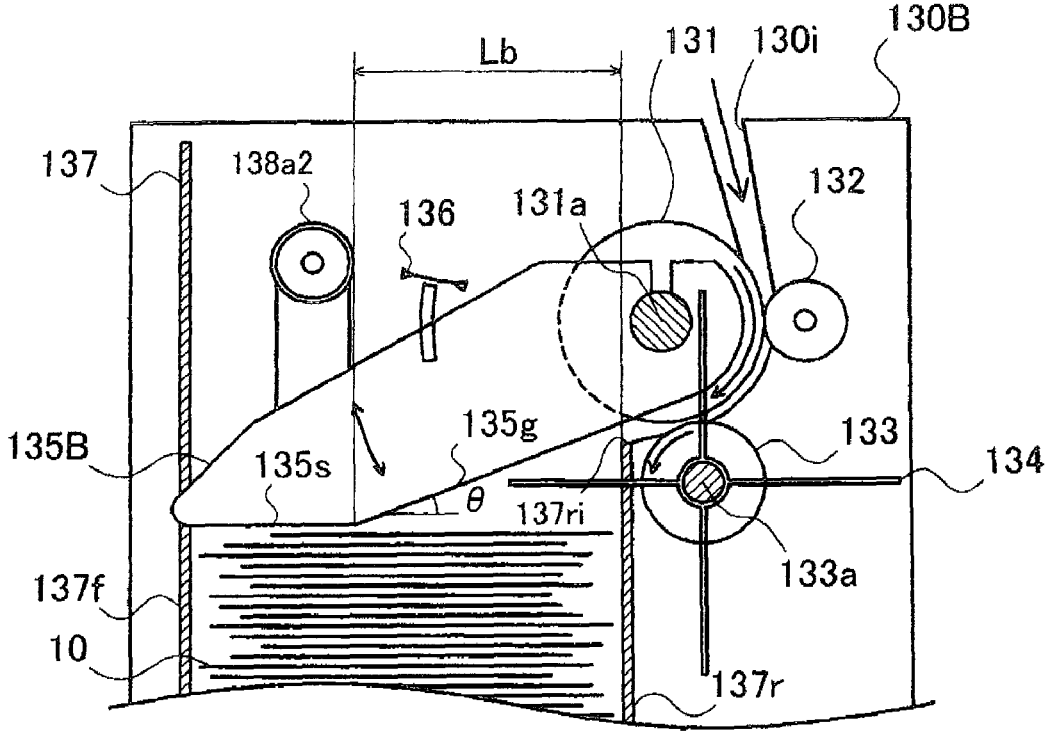
FIG. 6 shows the schematic structure of still another reject cartridge in another modified example.

FIG. 6 is a side sectional view showing the schematic structure of still another reject cartridge 130B in another modified example. The reject cartridge 130B of this modified example has a similar structure to that of the reject cartridge 130 of the embodiment, except a stack guide 135B provided in place of the stack guide 135.

In the reject cartridge 130B of the modified example, the stack guide 135B does not have the projection 135*d* provided on the stack guide 135 in the reject cartridge 130 of the embodiment. The top surface of the rejected bills 10 accumulated in the storage cartridge 137 is pressed by a lower face 135*s* of the stack guide 135B. A distance Lb between an edge 135*se* of the lower face 135*s* of the stack guide 135B and a $1^{st}$ side wall 137*r* is set to be less than the width WSmin of the minimum size rejected bill 10 in the widthwise direction shown in FIG. 4(*c*).

Like the reject cartridge 130 of the embodiment, the reject cartridge 130B of the modified example effectively reduces the potential for folding or creasing of the rejected bills 10 and their paper jams and relevant troubles in simultaneous accumulation of multiple different types of rejected bills 10 in different sizes in one storage cartridge 137 and thereby ensures stable accumulation of the rejected bills 10.

D3. Modified Example 3

In the cash handling apparatus 101 and the reject cartridge 130 of the embodiment, the conveying direction of the rejected bills 10 is set to the widthwise direction of the rejected bills 10. This is, however, neither restrictive nor essential. The conveying direction of the rejected bills 10 may alternatively be set to the longitudinal direction of the rejected bills 10. In this alternative arrangement, the distance L between the projection 135*d* of the stack guide 135 and the $1^{st}$ side wall 137*r* in the reject cartridge 130 is set to be less than the length WLmin of the minimum size rejected bill 10 in the longitudinal direction shown in FIG. 4(*c*).

D4. Modified Example 4

The reject cartridge 130 of the embodiment is equipped with the sheet roller 134. Although the sheet roller 134 is not an essential element, the sheet roller 134 works to effectively hit the rear end of each rejected bill 10 fed into the storage cartridge 137 and drop down the rejected bill 10 in the storage cartridge 137.

D5. Modified Example 5

In the reject cartridge 130 of the embodiment, the pivot shaft of the stack guide 135 is the rotating shaft 131*a* of the feed roller 131. The pivot shaft of the stack guide 135 is, however, not restricted to this arrangement but may be provided separately from the rotating shaft 131*a* of the feed roller 131.

D6. Modified Example 6

The above embodiment regards the paper sheet storing apparatus of the invention applied to the cash handling system 101 and the automatic teller machine 100. The paper sheet storing apparatus of the invention is, however, not restricted to this application but is also applicable to diversity of other systems, machines, and equipment, for example, copying machines and printing devices.

What is claimed is:

1. A paper sheet storing apparatus configured to collect and accumulate multiple different types of paper sheets in different sizes, the paper sheet storing apparatus comprising:

a paper sheet cartridge configured to have a feeder provided on a side wall thereof for externally feeding paper sheets and arranged to accumulate and keep the paper sheets therein;

a stack guide member configured to introduce the paper sheets, which are fed by the feeder into the paper sheet cartridge, downward in the paper sheet cartridge and to press down surface of an uppermost paper sheet located on a top of the paper sheets accumulated and kept in the paper sheet cartridge;

a detector configured to detect an angle of a guide plane of the stack guide member and a horizontal plane, where the guide plane of the stack guide member is formed to introduce the fed paper sheets downward in the paper sheet cartridge; and a lift controller configured to refer to the angle detected by the detector and control the lift mechanism to keep the angle constant, the stack guide member being structured in a specific shape to enable the surface of the uppermost paper sheet to be pressed downward in a vertical direction, with regard to all the multiple different types of paper sheets, and being arranged to be swung in the vertical direction, wherein the paper sheets are substantially rectangular in shape and are conveyed into the feeder in a substantially widthwise direction of the paper sheets or in a substantially longitudinal direction of the paper sheets as a conveying direction, and the stack guide member has a projection formed to press down the surface of the uppermost paper sheet, which is located on the top of the paper sheets accumulated and kept in the paper sheet cartridge, at least one point close to a centerline substantially parallel to the conveying direction.

2. The paper sheet storing apparatus in accordance with claim 1, wherein the conveying direction is the substantially widthwise direction of the paper sheets.

3. The paper sheet storing apparatus in accordance with claim 2, wherein a distance from the side wall of the paper sheet cartridge equipped with the feeder to the projection formed on the stack guide member is less than a length of a minimum size paper sheet in a widthwise direction thereof among the multiple different types of paper sheets.

4. The paper sheet storing apparatus in accordance with claim 1, wherein the paper sheet cartridge has a bottom plate formed in preset dimensions that are greater than dimensions of a maximum size paper sheet among the multiple different types of paper sheets.

5. The paper sheet storing apparatus in accordance with claim 1, wherein a vertically movable bottom plate member forms a bottom plate of the paper sheet cartridge, the paper sheet storing apparatus further having:

a lift mechanism to move up and down the bottom plate member.

6. The paper sheet storing apparatus in accordance with claim 1, the paper sheet storing apparatus further having:

a hitting member structured to hit rear ends of the paper sheets fed by the feeder into the paper sheet cartridge and thereby drop the paper sheets down into the paper sheet cartridge below the feeder.

7. A paper sheet handling system equipped with the paper sheet storing apparatus in accordance with claim 1.

8. An automatic teller machine equipped with the paper sheet handling system in accordance with claim 7.

9. The paper sheet storing apparatus in accordance with claim 1, wherein the stack guide member has a substantially plate-like shape and is arranged to be swung in the vertical direction about a preset pivot shaft provided above the feeder.

* * * * *

UNITED STATES PATENT AND TRADEMARK OFFICE

CERTIFICATE OF CORRECTION

PATENT NO. : 7,850,165 B2
APPLICATION NO. : 12/141945
DATED : December 14, 2010
INVENTOR(S) : Nagura et al.

It is certified that error appears in the above-identified patent and that said Letters Patent is hereby corrected as shown below:

Title Page,
Item (30) Foreign Application Priority Data, please amend as follows:

Jul. 9, 2007 (JP) 2007-179895

Signed and Sealed this
Twenty-third Day of August, 2011

David J. Kappos

David J. Kappos
*Director of the United States Patent and Trademark Office*